US009015905B1

(12) United States Patent
Chen

(10) Patent No.: US 9,015,905 B1
(45) Date of Patent: Apr. 28, 2015

(54) MAGNETICALLY SUSPENDED HYGIENIC HANDLE ASSEMBLY

(71) Applicant: MiniMax, Inc., Plano, TX (US)

(72) Inventor: Shyh-Min Chen, Plano, TX (US)

( * ) Notice: Subject to any disclaimer, the term of this patent is extended or adjusted under 35 U.S.C. 154(b) by 0 days.

(21) Appl. No.: 14/184,893

(22) Filed: Feb. 20, 2014

(51) Int. Cl.
*E05B 1/00* (2006.01)

(52) U.S. Cl.
CPC ..... *E05B 1/0069* (2013.01); *Y10S 16/904* (2013.01)

(58) Field of Classification Search
CPC ..... E05B 1/0069; E05B 1/0061; B62B 5/069; B62B 5/06; B62B 5/066; B62B 5/067; A47K 13/105; A47K 13/145; A47K 13/107; A47K 13/14; A47K 13/225; A47K 17/00; A61L 2/08; A61L 2/10; A61L 2/24; A61L 2/18; A61L 2/20; A61L 2/22; Y10S 16/904
USPC ..... 16/110.1, 111.1, 905, 903, 904, 422, 16/425, 412, 414; 422/292; 4/222, 220, 4/246.1, 228.5, 229, 230, 406, 405, 661, 4/315
See application file for complete search history.

(56) References Cited

U.S. PATENT DOCUMENTS

| | | | | |
|---|---|---|---|---|
| 4,644,689 | A | 2/1987 | Arians | |
| 4,658,469 | A | 4/1987 | Hawkins | |
| 4,997,139 | A | 3/1991 | Menard | |
| 5,913,609 | A * | 6/1999 | Lorenzi et al. | 4/243.3 |
| 6,289,557 | B1 | 9/2001 | Manson et al. | |
| 6,817,066 | B1 | 11/2004 | Williams et al. | |
| 7,360,674 | B2 | 4/2008 | Sassoon | |
| 7,598,501 | B2 * | 10/2009 | Jones | 250/455.11 |
| 7,611,156 | B2 | 11/2009 | Dunser | |
| 7,716,789 | B1 | 5/2010 | Zevallos | |
| 7,762,492 | B2 | 7/2010 | Muderlak et al. | |
| 7,850,114 | B2 * | 12/2010 | Lavy | 242/538 |
| 8,146,776 | B2 | 4/2012 | Balkin et al. | |
| 8,276,839 | B2 | 10/2012 | Muderlak et al. | |
| 8,658,106 | B2 * | 2/2014 | Van Zijl | 422/292 |
| 2005/0267233 | A1 * | 12/2005 | Joshi | 523/122 |
| 2006/0076743 | A1 | 4/2006 | Dunser | |
| 2007/0267828 | A1 | 11/2007 | Egizi | |
| 2008/0305020 | A1 | 12/2008 | Oshmyansky | |
| 2009/0071975 | A1 * | 3/2009 | Stropkay et al. | 222/1 |
| 2009/0117001 | A1 | 5/2009 | Hyde et al. | |

(Continued)

FOREIGN PATENT DOCUMENTS

| | | | |
|---|---|---|---|
| CA | 2161935 | A * | 5/1997 |
| EP | 2071104 | A1 | 6/2009 |
| GB | 2387542 | A * | 10/2003 |

*Primary Examiner* — Chuck Mah
(74) *Attorney, Agent, or Firm* — Vincent J. Allen; Carstens & Cahoon, LLP

(57) ABSTRACT

Disclosed herein are a hygienic handle assembly and related methods for automatically advancing a clean portion of a protective sleeve over a handle after use of the handle by a person. In one embodiment, an exemplary hygienic handle assembly comprises a pair of first magnetic couplers, each having a passage therethrough, and a handle extending between the pair of first magnetic couplers and having a second magnetic coupler at each of its opposing ends. Each of the second magnetic couplers may be configured to be located within at least a portion of a corresponding first magnetic coupler, wherein magnetic fields of the first magnetic coupler repel magnetic fields of the second magnetic couplers received therein such that each second magnetic coupler is magnetically suspended within the corresponding first magnetic coupler.

27 Claims, 4 Drawing Sheets

(56) References Cited

U.S. PATENT DOCUMENTS

| | | | | |
|---|---|---|---|---|
| 2009/0293183 | A1* | 12/2009 | Wei | 4/243.3 |
| 2012/0074717 | A1 | 3/2012 | Macfarlane | |
| 2012/0131756 | A1 | 5/2012 | Gilsenan et al. | |
| 2012/0176241 | A1* | 7/2012 | Pasch et al. | 340/540 |
| 2013/0118085 | A1 | 5/2013 | Hedemark | |
| 2013/0279966 | A1* | 10/2013 | Roberts et al. | 401/207 |
| 2014/0137369 | A1* | 5/2014 | Street | 16/111.1 |
| 2014/0208541 | A1* | 7/2014 | Cowburn | 16/110.1 |
| 2014/0259337 | A1* | 9/2014 | Melvin et al. | 4/237 |
| 2014/0259340 | A1* | 9/2014 | Cox | 4/243.2 |

* cited by examiner

MAGNETICALLY SUSPENDED HYGIENIC HANDLE ASSEMBLY

TECHNICAL FIELD

The disclosed principles generally relates to increasing hygiene for users of handles, and more particularly to a hygienic handle assembly and related methods having an automated hygienic protective sleeve.

BACKGROUND

The presence of sanitary conditions contributes to the health of all people, and a sanitation issue well recognized is that of public door handles, which can be contaminated with germs and other contagions, as well as contaminants left on the handle by a previous user of the handle. Among these contaminants are skin oils and common dirt, as well as potentially more harmful substances such as bacteria, fungi and other pathogens. Such contaminants easily can be transmitted to the hand of anyone who grasps the handle to open the door. Moreover, if the skin of the later user's hand is not intact due to lacerations, abrasions, or other sores, there is a high probability that percutaneous exposure to pathogens can occur. Even if the skin of the user's hand is intact, contaminants may remain viable on the hand and cause infection when the user contacts his eyes, nose, or mouth if these areas are contacted before thorough washing of the hand takes place.

Among the most potentially unsanitary door handles are those used on public restroom doors, hospital doors, and doors for accessing locations such as restaurants, stores, industrial buildings, commercial garages, and even office buildings. In addition to doors, numerous other potentially unsanitary handles also exist, such as grocery store carts, and each also provides the opportunity to pass germs and other contagions from one person to another. Providing cleanliness of such handles has long been a challenge, and has been one addressed by a number of prior devices. However, such prior devices tend to be expensive, overly complex, or require the replacement of an entire door or other object having the potentially unsanitary handle. Individual disposable handle protection items, such as napkins placed near the handle, have also been tried, but these approaches create the issue of disposable waste, which typically results in excess garbage and litter scattered around the area of use.

Accordingly, what is needed in the art is a simple handle apparatus that provides a sanitary surface for each person using a handle, thus protecting a later user from touching the same handle surface previously touched by another user, but that does not suffer from the deficiencies of conventional approaches. Moreover, a viable solution should be inexpensive, not overly complex, and should be capable of retrofitting existing doors, drawers, etc. The disclosed principles provide such a solution.

SUMMARY

Disclosed herein are a hygienic handle assembly and related methods having a magnetically suspended handle for advancing a clean portion of a protective sleeve over a handle after use of the handle by a person. The disclosed assembly may be used in any situation where a user desires to grasp a sanitary handle after other persons have used the same handle. In some embodiments, the disclosed handle assembly may simply be attached to an existing object that opens as closes, such as a push/pull handle for a door, a handle for a drawer, a shopping cart handle, or any other type of application. Moreover, a handle assembly as disclosed herein may be retrofitted to replace existing mechanized handle assemblies. For examples, in embodiments where the disclosed assembly replaces a conventional turning and optionally locking door handle, the disclosed handle assembly may comprise mechanisms configured to operate with conventional door latching and locking mechanisms associated with door handles.

In one embodiment, an exemplary hygienic handle assembly comprises a pair of first magnetic couplers, each having a passage therethrough, and a handle extending between the pair of first magnetic couplers and having a second magnetic coupler at each of its opposing ends. Each of the second magnetic couplers may be configured to be located within at least a portion of a corresponding first magnetic coupler, wherein magnetic fields of the first magnetic coupler repel magnetic fields of the second magnetic couplers received therein such that each second magnetic coupler is magnetically suspended within the corresponding first magnetic coupler. Such an assembly may further comprise a tubular sleeve configured to pass through each of the passages of the first magnetic couplers and around the second magnetic couplers and the handle such that the tubular sleeve encloses the second magnetic couplers from the first magnetic couplers. The exemplary assembly may also comprise a sleeve advancer configured to advance the tubular sleeve over the handle after use of the handle by a user such that sleeve material covering the handle prior to advancement is substantially replaced by new sleeve material after advancement.

In another embodiment, a hygienic handle assembly in accordance with the disclosed principles may comprise a handle shaft having a first end and a second end, and a first magnet attached to the first end of the handle shaft. Such a handle assembly may further comprise a first receptacle for loosely coupling with the first end of the handle shaft, where the first receptacle has a second magnet configured to oppose a magnetic field of the first magnet such that the first end of the handle shaft is suspended within the first receptacle. Such a handle assembly may further comprise a second receptacle for loosely coupling with the second end of the handle shaft. Additionally, in such embodiments, a sleeve may be provided and configured to pass through the first and second receptacles and around the first and second ends of the handle shaft such that the sleeve encloses the first magnet from the second magnet. Furthermore, handle assemblies in such embodiments may also include a sleeve advancer configured to advance the sleeve over the handle shaft after use of the handle shaft by a user such that sleeve material covering the handle shaft prior to advancement is substantially replaced by new sleeve material after advancement.

BRIEF DESCRIPTION OF THE DRAWINGS

Embodiments are illustrated by way of example in the accompanying figures, in which like reference numbers indicate similar parts, and in which.

DETAILED DESCRIPTION

Figure 1:
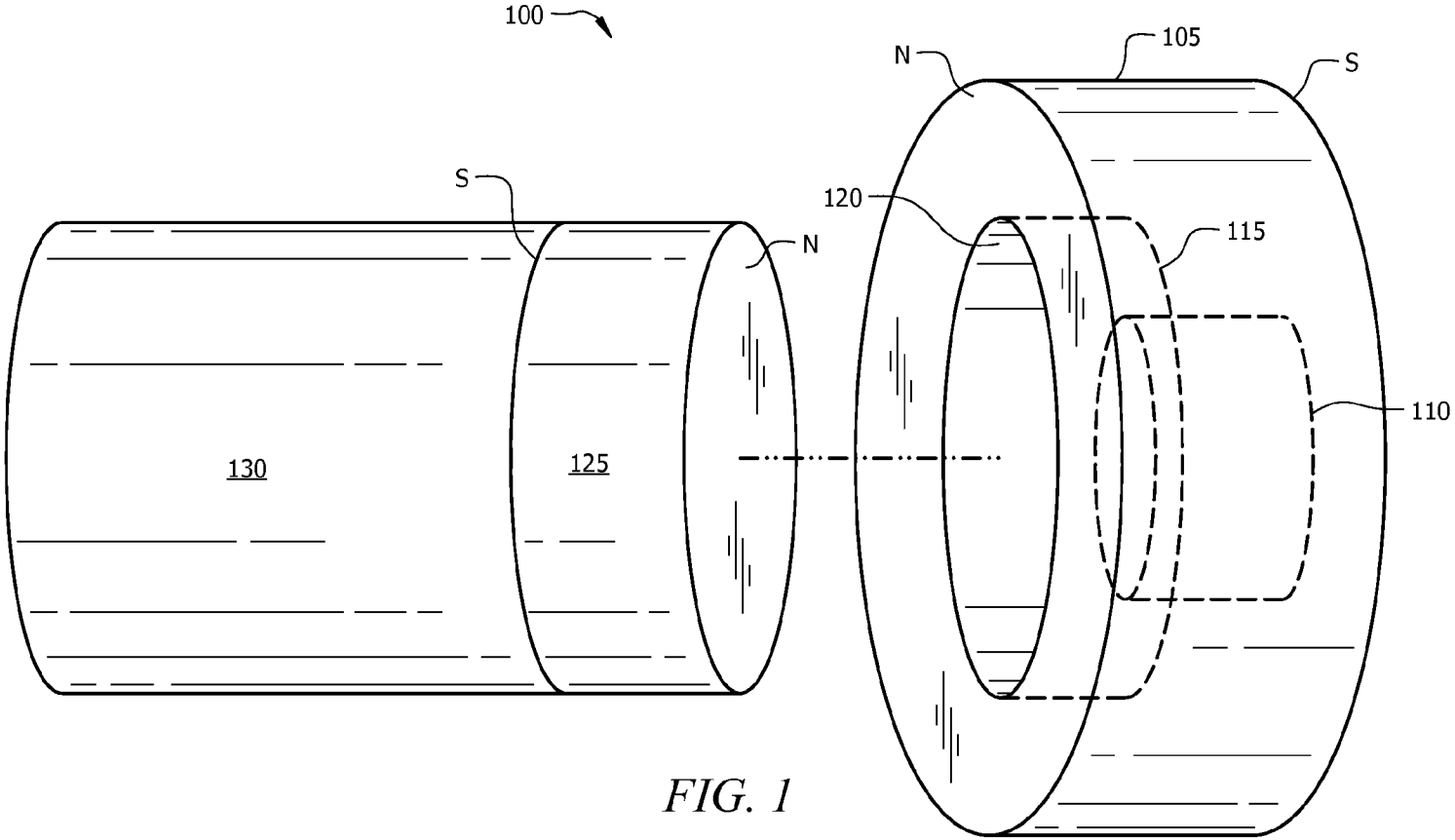
FIG. 1 illustrates one embodiment of the magnetic relationship that may be used at one end of a hygienic handle in accordance with the disclosed principles.

FIG. 1 illustrates one embodiment of the magnetic relationship that may be used at one end 100 of a hygienic handle assembly in accordance with the disclosed principles. More specifically, the disclosed principles provide for the magnetic suspension of at least one end of a handle so as to create a space between a handle portion grasped by a user, and the unit connecting the handle to a door, drawer, or other object. By providing such a space between these portions of a handle assembly, a protective sleeve may be passed over the handle portion to increase hygiene for users that grasp the handle.

In advantageous embodiments, a first magnetic coupler 105 is provided, which has a passage 110 formed from one end of the first magnetic coupler 105 through to the other end. In addition, the first magnetic coupler 105 includes a stepped recess 115 formed in one side of the first magnetic coupler 105, which results in a larger receiving opening 120 on one end of the first magnetic coupler 105. The receiving opening 120 is sized to receive therein a second magnetic coupler 125. As illustrated, the second magnetic coupler 125 is mounted at an end of a handle unit 130, which may be the area that is grasped by a user to open a door or other item on which the disclosed hygienic handle assembly is mounted.

In accordance with the disclosed principles, both the first and second magnetic couplers 105, 125 comprise magnetic poles, which are illustrated as "N" for North and "S" for South. As is well known, the magnetic fields of a magnet flow from the North pole of the magnet to its South pole. In addition, it is also well known that similar poles of two magnets will repel one another, while opposite poles will attract one another. Thus, as illustrated, the first magnetic coupler 105 is formed with its North pole oriented towards the second magnetic coupler 125, and its South pole on the farthest end from the second magnetic coupler 125. Similarly, the North pole of the second magnetic coupler 125 is oriented towards the first magnetic coupler 105, while its South pole is oriented on the end farthest from the first magnetic coupler 105. Consequently, with their North poles oriented towards each other, the first and second magnetic couplers 105, 125 will repel each other, and thus the handle 130 is repelled from the first magnetic coupler 105.

In addition to this lateral repulsion of the handle 130 from the first magnetic coupler 105, magnetic fields are also present in the receiving opening 120. Therefore, as the second magnetic coupler 125 is received within the receiving opening 120, the magnetic fields not only laterally repel the second magnetic coupler 125 from the first magnetic coupler 105, but the external diameter of the second magnetic coupler 125 is also repelled by the internal, surrounding diameter of the receiving opening 120. As a result, not only is the second magnetic coupler 125 laterally repelled away from the first magnetic coupler 105, but the magnetic field within the receiving opening 120 works against the magnetic field of the second magnetic coupler 125 to center the second magnetic coupler 125 within the receiving opening 120 when the second magnetic coupler 125 is forcibly held within the receiving opening 120.

The magnetic principles discussed above may then be employed to magnetically suspend the second magnetic coupler 125 substantially concentric within the first magnetic coupler 105, but without having these two components physically touch each other when brought together. Accordingly, an unblocked space may be maintained between the first and second magnetic couplers 105, 125 when the second magnetic coupler 125 is secured in close proximity to the first magnetic coupler 105 within the receiving opening 120. In accordance with the disclosed principles, that space provided by the magnetic fields may then be used to provide a material between the first and second magnetic couplers 105, 125, as described in further detail below.

Figure 2:
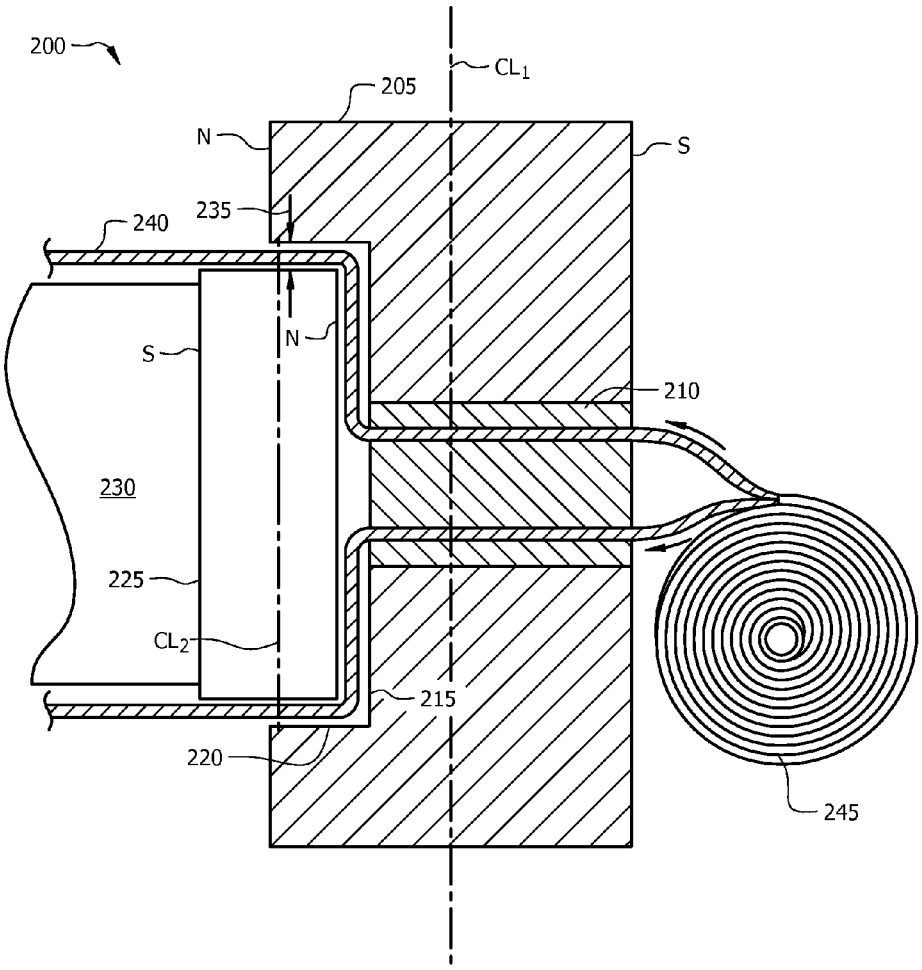
FIG. 2 illustrates a close up cross-sectional side view of one end of a hygienic handle constructed in accordance with the disclosed principles.

FIG. 2 illustrates a close up cross-sectional side view of one end 200 of a hygienic handle assembly constructed in accordance with the disclosed principles. In this illustrated embodiment, the magnetic suspension of at least one end of a handle is again illustrated, as well as the space created between the handle portion grasped by a user and the unit connecting the handle to a door, drawer, or other object.

The handle assembly end 200 again includes a first magnetic coupler 205, which again includes a passage 210 therethrough. Also as before, a stepped recess 215 is provided extending from the passage 210, and that stepped recess 215 provides a receiving opening 220 that is larger than the passage 210 extending through the first magnetic coupler 205. A second magnetic coupler 225, which is located at one end of a handle 230, is sized to fit within the receiving opening 220. However, in accordance with the disclosed principles, the outer diameter of the second magnetic coupler 225 is sized small enough with respect to the receiving opening 220 so that a space 235 is provided between the first and second magnetic couplers 205, 225.

In accordance with the principles disclosed herein, the magnetic poles (designated "N" for North and "S" for South in FIG. 2) of the first and second magnetic couplers 205, 225 are selected so that the two magnetic couplers 205, 225 repel each other. In this exemplary embodiment, the North poles of the two magnetic couplers 205, 225 are oriented closest to one another, while the South poles are oriented farthest away from one another.

With their North poles oriented towards each other, the first and second magnetic couplers 205, 225 will repel each other, and thus the handle 230 is repelled away from the first magnetic coupler 205 to create the space 235 between these components. Importantly, in addition to this lateral repulsion of the handle 230 from the first magnetic coupler 205, magnetic fields are also vertically provided in the receiving opening 220. Therefore, when the second magnetic coupler 225 is located within the receiving opening 220, the magnetic fields not only laterally repel the second magnetic coupler 225 from the first magnetic coupler 205, but the external diameter of the second magnetic coupler 225 is also vertically repelled by the internal, surrounding diameter of the receiving opening 220. As a result, not only is the second magnetic coupler 225 laterally repelled away from the first magnetic coupler 205, but the magnetic field within the receiving opening 220 works against the magnetic field of the second magnetic coupler 225 to center the second magnetic coupler 225 within the receiving opening 220 when the second magnetic coupler 225 is held in place within the receiving opening 220.

To provide both vertical repulsion by the internal walls of the receiving opening 220, the depth of the receiving opening 220 formed into the first magnetic coupler 205 may be limited so that it does not extend beyond the approximate center of the first magnet coupler 205 (designated as centerline $CL_1$ in FIG. 2). By limiting the depth that the receiving opening 220 is formed within the first magnetic coupler 205 to less than one-half of the thickness of the first magnetic coupler 205, only the electrical charges associated with the North pole of the first magnetic coupler 205 are located around the receiving opening 220. Additionally, in advantageous embodiments, the horizontal thickness of the second magnetic coupler 225 may be selected so that less than one-half of the second magnetic coupler 225 is received within the receiving opening 220. As illustrated in FIG. 2, the size of the second magnetic coupler 225 is selected such that second magnetic coupler 225 is not received within the receiving opening 220 beyond its horizontal center (illustrated as centerline $CL_2$). As with the electrical charge of the magnetic field in the receiving opening 220, by limiting the amount of the second magnetic coupler 225 that is received within the first magnetic coupler 205, only the electrical charges associated with the North pole of the second magnetic coupler are located within the receiving opening 220. Accordingly, since the portions of both the first and second magnetic coupler 205, 225 that are positioned within close proximity to one another have the same magnetic poles and thus are both magnetically charged with the same polarity, magnetic repulsion in both the horizontal and vertical directions is created. Additionally, although the first magnetic coupler 205, the second magnetic coupler 225, and the receiving opening 220 are illustrated in a cylindrical shape, it should be understood that any shapes are possible so long as space is provided between the first and second magnetic couplers 205, 225 as disclosed herein. Moreover, no limitation to any particular type of magnet for the first or second magnetic coupler 205, 225 should be implied. In some embodiments, rare earth magnets or so-called "super" magnets may be employed. One such suitable magnet is the neodymium magnet. In other embodiments, electromagnets may be employed, which may be configured to activate when it is the time to advance sleeve.

By providing magnetic repulsion in both the horizontal and vertical directions, a substantially uniform space 235 may be provided between the first and second magnetic couplers 205, 225. The space 235 provided between these components of the handle assembly allow a protective sleeve 240 to be passed over the handle portion 230 in order to provide hygienic protection for users that grasp the handle 230. More specifically, a roll 245 of protective sleeve material 240 may be positioned near the end 200 of a handle assembly constructed as disclosed herein. Although a roll is illustrated for the supply roll 245, it should be understood that any type of sleeve supply may be implemented with the disclosed principles. That protective sleeve 240 is then passed over the handle 230 so that when a user grasps the handle 230, the user only contacts the protective sleeve 240. The space 235 between the first and second magnetic couplers 205, 225 can be made large enough to allow advancement of the sleeve 240, but small enough to allow users to pull on the handle without a noticeable or distracting amount of play between the first and second magnetic couplers 205, 225. Moreover, although the handle 230 is illustrated as cylindrical and linear, the disclosed principles are not limited to any particular handle shape, cross section or otherwise, so long as a protective sleeve 240 of any shape can still be advanced over the handle 230 to provide a clean surface for the next user.

Once a user finishes his use of the handle 230, e.g., the user has pulled the handle 230 sufficiently to open the door, drawer, etc. on which the handle assembly is mounted, he releases the handle 230. Once the handle 230 is released, the disclosed principles further provide for an automated advancing mechanism to advance the protective sleeve 240 over the length of the handle 230, as illustrated by the directional arrows in FIG. 2, until the handle 230 is covered with a length of sleeve material 240 that has not yet been touched, etc., and thus is sanitary to touch by other users. A discussion of exemplary mechanisms for advancing the sleeve 240 over the handle 230 is provided below. By automatically advancing a new length of sanitary sleeve material 240 over the handle 230 after each use of the handle 230 by a person, the disclosed principles provide a unique and consistent system and method for providing a hygienic handle for users to grasp without additional effort on the part of the users.

Figure 3:
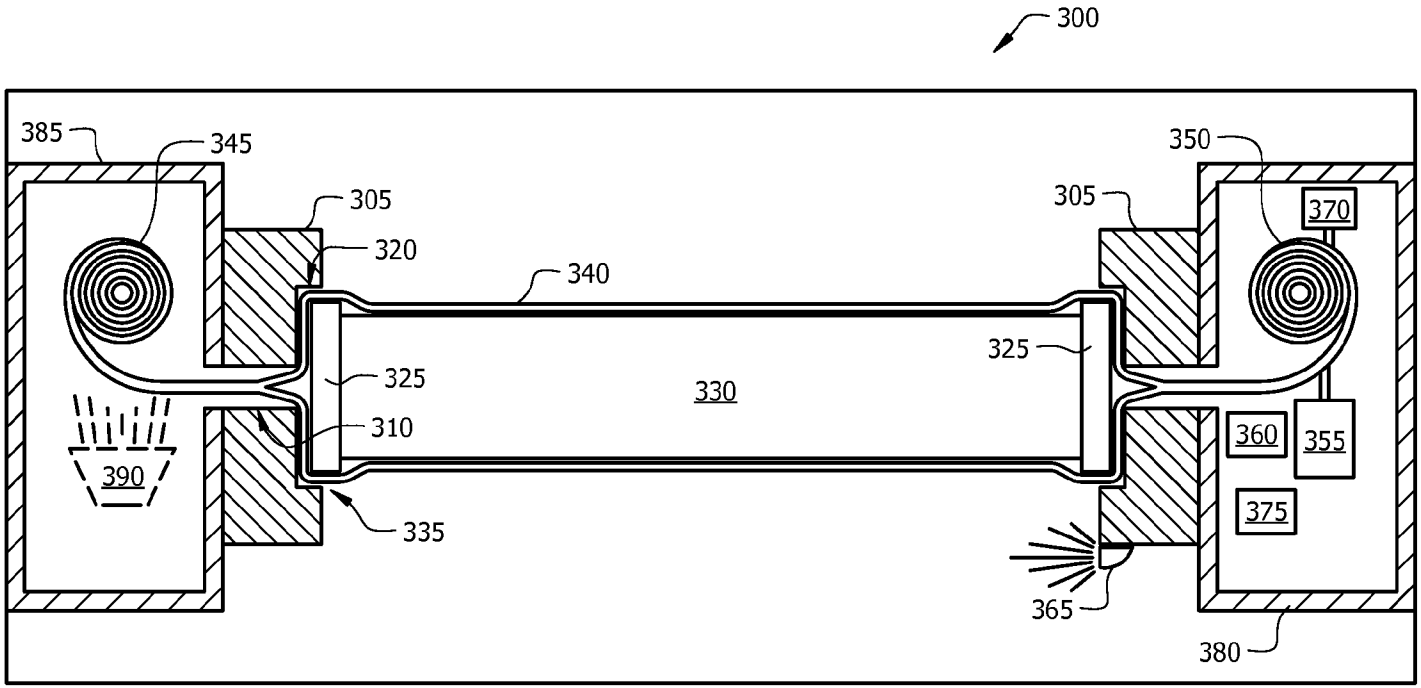
FIG. 3 illustrates a front view of one embodiment of a complete hygienic handle in accordance with the disclosed principles.

FIG. 3 illustrates a cross-sectional top view of one embodiment of a complete hygienic handle assembly 300 in accordance with the disclosed principles. As with previously described embodiments, the handle assembly 300 includes first magnetic couplers 305 at opposing ends of handle 330 grasped by users. In addition, the assembly 300 includes second magnetic couplers 325, which are magnetically suspended within receiving openings 320 of the first magnetic couplers 305 in the manner discussed in detail above.

The first magnetic couplers 305 also include passages 310 through each coupler 305 to provide a path to feed the protective sleeve 340. The magnetic suspension between the first and second magnetic couplers 305, 325 creates a space 335 that provides a path through which the protective sleeve 340 can pass over the handle 330. As before, the protective sleeve 340 may be provided from a sleeve supply roll 345 located at one end of the assembly 300. As the protective sleeve 340 is advanced over the handle 330, the used sleeve material 340 may be collected on a used sleeve roll 350. In this embodiment, the advancing mechanism used to advance the sleeve 340 from the supply roll 345 to the used sleeve roll 350 is an electric motor 355. The motor 355 can be attached to the used sleeve roll 350 by any means, such as via one or more gears or belts and pulleys, in order to turn the roll 350 at the appropriate time.

To determine the appropriate moment to advance the sleeve 340 so that a new, clean length of sleeve material 340 is over the handle 330, control circuitry 360 is also provided. In the illustrated embodiment of FIG. 3, the handle assembly 300 includes a sensor 365, such as a motion sensor, for detecting when the sleeve 340 should be advanced. More specifically, after a user has finished pulling or pushing the handle 330 sufficiently to open the door, drawer, etc. on which the handle assembly 300 is mounted, the user will release his grasp and remove his hand from the handle 330. The illustrated sensor 365 may be positioned to detect when a user's hand is on or near the handle 330, and likewise when that user's hand is no longer on or near the handle 330. Based on this detection, the control circuitry 360 may then trigger operation of the motor 355 to advance the sleeve material 340 for the next user. Accordingly, when the sensor 365 detects that the user's hand is no longer on or near the handle 330, that detection by the sensor 365 can be used, via the control circuitry 360, to automatically trigger the advancing mechanism to advance the protective sleeve 340 over the length of the handle 330 until the handle 330 is covered with a length of sleeve material 340 that is sanitary to touch by other users. In other embodiments, a touch-based sensor rather than a motion sensor may be employed in the same manner. Such a touch sensor may be configured to detect when a user's fingers or hand touches the handle 330, and thus when it no longer touches the handle 330, and advance the sleeve 340 accordingly.

In other embodiments, automatic advancing of the sleeve 340 may be triggered with an electrical circuit connected between the first and second magnetic couplers 305, 325. More specifically, as a user pulls or pushes the handle 330, the force of the user's push or pull is counteracted by the weight, friction, or other resistance provided by the door, drawer, etc. being opened or closed. When that resistance is sufficient to overcome the magnetic suspension between the first and second magnetic couplers 305, 325, the two couplers 305, 325 will be brought together. If a thin enough sleeve material 340 is employed, an electrical circuit can be closed when the first and second magnetic couplers 305, 325 are brought together, even with the sleeve 340 between them. The closing and subsequent reopening of that electrical circuit can thus be used by the control circuitry 360 to automatically advance the sleeve 340 when the user ceases pushing or pulling the handle.

The control circuitry 360 may also be designed and configured to not only provide power to operate the motor 355 at the appropriate moment, but to also ensure that a proper length of new sleeve material 340 from the supply roll 345 is provided over the handle 330 after each use. This may be accomplished using, for example, sensors on any gears or pulleys used to turn the used sleeve roll 350, sensors configured to determine the amount of sleeve material 340 passing over the handle 330, a preconfigured time for operating the motor 355 sufficient to provide a complete length of clean sleeve material 340, or any other means for determining that enough clean sleeve material 340 has been placed over the handle 330. The control circuitry 360 may also work in conjunction with a "service" sensor 370, which may be included in the assembly 300 to determine when the sleeve material 340 should be replaced. For example, the service sensor 370 may be configured to detect when the used sleeve roll 350 reaches a certain diameter, thus indicating that all or close to all of the sleeve material 340 has been exhausted and should be replaced with a new supply roll 345. Of course, other techniques for detecting that the supply of sleeve material 340 has been exhausted, such as if the supply roll 345 will no longer turn because the end of the sleeve materials 340, which may be tethered to the core of the roll 345, has reached its end, may also be employed with the disclosed principles, and any such techniques are still within the broad scope of the present disclosure. Additionally, an indicator, such as a light or other visual cue, or a buzzer or other audio cue, may also be triggered by the mechanism detecting that the supply of sleeve material 340 has been exhausted.

It should be understood that any mechanism may be implemented to automatically advance the sleeve material 340 at the appropriate moment after the handle's 330 use, to determine that an appropriate length of the sleeve material 340 has been advanced, to detect that a new supply of sleeve material 340 is needed, or to detect that an error in the advancing of the sleeve material 340, such as jamming of the material during operation, and that any such mechanisms or techniques are encompassed by the broad scope of the disclosed principles. In addition, those who are skilled in this technical field will readily be capable of providing appropriate control circuitry 360 to operate the motor 355 at the appropriate times and in the appropriate manner, as well as to employ any such detection technique to alter or cease the advancement of the sleeve material 340, if needed, and even to provide an indication, such as an audio or visual cue, to service personnel that an error or other problem has occurred. Additionally, for all mechanisms that may be employed to automatically advance the sleeve 340 after use of the handle 330, a delay may be provided by the control circuitry 360 to give sufficient time for a user to remove his hand from the handle 330, since prematurely advancing the sleeve 340 may result in tearing of the sleeve 340 or its bunching up around the user's hand. Furthermore, the control circuitry 360 may be configured to stop the advancing of the sleeve 340 if another grasp or pull/push of the handle 330 is detected.

Power to electric motor 355 and control circuitry 360 may be provided from a local power supply 375, such as a battery power supply. Alternatively, the electrical components in the handle assembly 300 may be hardwired through the door, drawer, or other object on which the handle assembly 300 is mounted, and thus the power provided from a wired supply in the building or other structure. In some embodiments, solar collection panels may even be provided so as to provide power to the electrical components in the handle assembly 300. Accordingly, any appropriate power supply may be provided with a handle assembly according to the disclosed principles, and no limitation to any particular power source should be implied. Furthermore, some or all of the components for use in automatically advancing the sleeve material 340 after each use of the handle 330 may be concealed within a discrete casing 380. Such a casing 380 may be removable so that components in the assembly 300 may be accessed and serviced, and may even include a locking mechanism to prevent unauthorized users to open the casing 380.

At the opposing end of the handle 330 from the casing 380 and components discussed above, a second casing 385 may also be provided. The second casing 385 may be used to enclose the supply roll 345 holding the new, clean sleeve material 340 that will be advanced over the handle 330 after each use. This casing 380 may also be removable so that new supply rolls 345 may be provided after the prior supply roll 345 is exhausted. Moreover, the mechanism by which the supply roll 345 becomes exhausted or is closed to being exhausted may be included within the second casing 385 at this end of the assembly 300. Thus, the disclosed principles do not limit the location of any one or more components to either end of the handle assembly 300. Additionally, the sensor or other mechanism by which the removal of a user's hand from the handle 330 is detected may also be included at this opposing end of the assembly 300, and thus no limitation to a specific location of a user detection mechanism should be implied. Furthermore, although the embodiment illustrated in FIG. 3 has both ends of the assembly 300 secured to a plate or other base, the disclosed principles are not so limited. Accordingly, the handle assembly 300 may be a pivoting handle for opening and closing a door or other object, and thus only one end of the handle assembly 300 should be secured to the door. In such embodiments, the end having the supply roll 345 may be configured with fewer components and little to no wiring when compared to the opposing end having the mechanism used pull the sleeve material 340 over the handle 30 after each use. Therefore, the end with the supply roll 345 may be provided on the unsecured end of the assembly 300 and thus free to move when the handle 330 is turned by a user.

As is clear from the discussion herein, an object of the disclosed principles is to provide a clean or sanitary surface for users to grasp when using the handle 330. In some embodiments of the disclosed principles, the sleeve material 340 is provided from a supply roll 345 that is itself sanitary or sterile. In such embodiments, the supply roll 345 may be enclosed in sanitary packaging within the second casing 385. In other embodiments, however, the new supply of sleeve material 340 may be sanitized as it is removed from the supply roll 345 and fed out of the second casing 385 and over the handle 330. For example, an optional ultraviolet (UV) light source 390 may be provided proximate to the supply roll 345, which can help sanitize the new sleeve material 340 as it is pulled from the supply roll 345. In other embodiments, a sanitizing spray or mist may instead, or additionally, be provided from a spray mechanism located proximate to the new supply of sleeve material 340. In any such embodiment, while the sleeve supply roll 345 may be thought to be clean because of its new condition, the addition of a sanitizing mechanism can ensure that the new sleeve material 340 supplied over the handle 330 is in fact clean and safe for future users to touch.

Of course, any other type of sanitizing mechanism capable of sanitizing the sleeve material 340 as it is removed from the supply roll 345 may also be used with a handle assembly 300 as disclosed herein, and thus no limitation to any particular sanitizing mechanism, if included with the assembly 300, should be implied.

Figure 4:
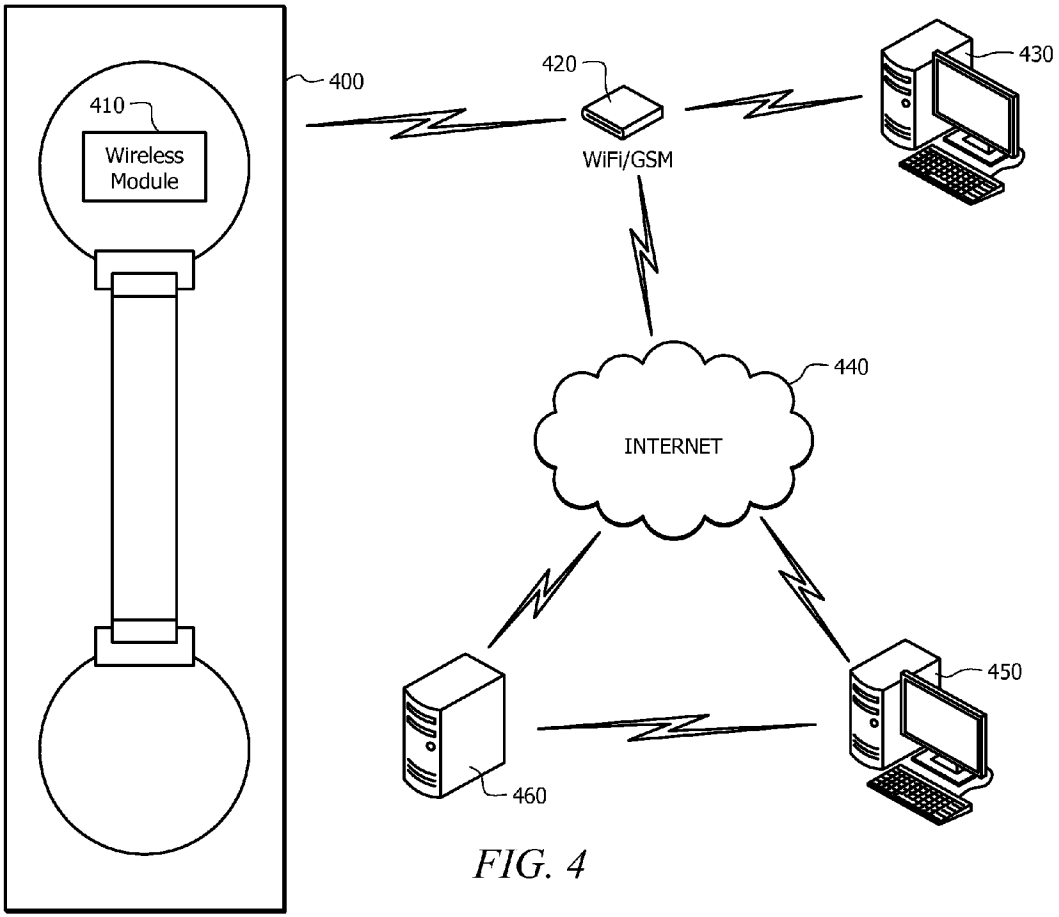
FIG. 4 illustrates another exemplary embodiment of a handle assembly in accordance with the disclosed principles having a data communications module.

Further to the components discussed above, a handle assembly constructed in accordance with the disclosed principles may also include a wireless communications module. FIG. 4 illustrates another exemplary embodiment of a handle assembly 400 in accordance with the disclosed principles having a data communications module 410. As illustrated, the handle assembly 400 may be configured to communicate via the data communications module 410 on a wireless computer network, for example, using a WiFi or GSM-based router 420. Although wireless communication is illustrated in FIG. 4, wired communication between the assembly 400 and a network may alternatively be provided through a hardwired communication, such as through an Ethernet connection. In such embodiments, the wireless communications module 410 would be a wired communications module. Additionally, although the embodiment in FIG. 4 illustrates wireless communication using the WiFi or GSM standard, other wireless communication standards, such as Bluetooth®, Zigbee®, or any other standard may also be employed.

A communications module 410, whether wired or wireless, may be used to communicate any one or more of the issues discussed above. For example, the communications module 410 may be used to signal that the supply of new sleeve material has been exhausted or will soon be exhausted, or that the power supply for advancing the sleeve material is running low. Additionally, the communications module 410 could be configured to signal that a jam in the advancing of the sleeve material has occurred, or that a component, such as the electric motor, of the handle assembly 400 has malfunctioned. Still further, if a sanitizing device is employed, such as a spray or UV light supply, the communications module 410 may be configured to signal that the sanitizing device has been exhausted or has malfunctioned.

Communications from the handle assembly 400 may be provided locally, for example, to a local computing device 430, which may also be connected to the local router 420. In such embodiments, local monitoring and servicing of one or more handle assemblies 400 as disclosed herein can be provided. For example, the local computing device 430 may be in the maintenance department of a building that includes multiple assemblies 400 on its bathroom doors, etc. Furthermore, the computing device 430 maybe a mobile computing device, such as a computing tablet or mobile telephone. In those embodiments, the mobile computing device will still receive communications from the assembly 400, while allowing those communications to be received at any location. For example, communications via a WiFi network can allow the user of the mobile computing device to be anywhere in the local WiFi network, while communications via GSM or other telephone communications network will allow the user of the mobile computing device to receive communications anywhere within the telephone communications network.

In other embodiments, the router 420 may be used to connect the local network to a larger computer network, such as the Internet 440. In those embodiments, information provided by the handle assembly 400 can be communicated to one or more computers 450 that may not be geographically located proximate to the structure in which the assembly 400 is located. Such embodiments would be advantageous for a service company maintaining multiple assemblies in one or more geographic locations. Such a service company could thus provide constant real-time monitoring of each assembly 400, and quickly address any concerns communicated by an assembly 400. Moreover, communications from one or more assemblies 400 may be transmitted to or retrieved from a database 460. Such a database 460 may be configured to store such communications to create, for example, a service history for each assembly 400 or even for each location having one or more assemblies. That stored data can provide historical information on assemblies 400 and locations having assemblies 400 for use in determining, for example, service calls to repair assemblies or to replace batteries or supply rolls of sleeve material, to establish a history on the age of components in an assembly or an assembly as a whole, or simply for billing purposes for customers using the assemblies. Of course, other uses for such data is also possible, and no limitation to any particular use is intended.

As discussed above, by automatically advancing a new length of sanitary sleeve material over a handle after each use of the handle by a user, the disclosed principles provide a unique and consistent system and method for providing a hygienic handle for multiple users to grasp without fear of germs or other contagions, and without additional effort on the part of each user. Such a handle assembly may be advantageously used as a door handle, a drawer handle, or any use that involves multiple persons touching or grasping the same handle. Accordingly, a handle assembly as disclosed herein may even be employed on a shopping cart or any other type of handle bar, whether stationary or mobile, that may be grasped by multiple people. Furthermore, when employed as a handle for opening and closing a door or other object, both ends of the handle need not be secured to the door, and thus the free end of a pivoting handle may still contain a sleeve supply roll, as discussed above. The disclosed principles may even be employed in embodiments where a sanitary surface is not necessary after each use of the handle, for example, in an automobile repair shop where dirty hands are often used to open doors, drawers, etc. In such locations, an assembly as disclosed herein may be configured to advance a clean sleeve over the handle only after a predetermined number of handle uses is detected, or even by an action of the next user of the handle, such as a verbal cue or the stepping on a switch near the assembly. In sum, the disclosed principles provide a unique handle assembly where one or both ends of the handle are held by magnetic suspension such that the handle surface can quickly and easily be provided with a new protective sleeve prior to being grasped.

While various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called field. Further, a description of a technology in the "Background" is not to be construed as an admission that certain technology is prior art to any embodiment(s) in this disclosure. Neither is the "Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

I claim:

1. A hygienic handle assembly, comprising:

a pair of first magnetic couplers, each having a passage therethrough;

a handle extending between the pair of first magnetic couplers and having a second magnetic coupler at each of its opposing ends, each of the second magnetic couplers configured to be located within at least a portion of the passage of a corresponding first magnetic coupler, wherein magnetic fields of the pair of first magnetic couplers repel corresponding magnetic fields of the second magnetic couplers received therein such that each second magnetic coupler is magnetically suspended within the corresponding first magnetic coupler;

a sleeve configured to pass through each of the passages of the first magnetic couplers and around the second magnetic couplers and the handle such that the sleeve encloses the second magnetic couplers from the first magnetic couplers; and a sleeve advancer configured to advance the sleeve over the handle after use of the handle by a user such that sleeve material covering the handle prior to advancement is substantially replaced by new sleeve material after advancement.

2. A hygienic handle assembly in accordance with claim 1, wherein each of the second magnetic couplers comprise a cylindrical shape sized to fit within stepped recesses located in the passage on a first end of each of the first magnetic couplers with the sleeve therebetween.

3. A hygienic handle assembly in accordance with claim 1, further comprising a sleeve supply located proximate to one first magnetic coupler for providing the sleeve into the passage of the first magnetic coupler.

4. A hygienic handle assembly in accordance with claim 3, further comprising a sleeve receiver located proximate to the other of the first magnetic couplers for receiving the provided sleeve from the passage of the other first magnetic coupler.

5. A hygienic handle assembly in accordance with claim 4, wherein the sleeve supply comprises a roll of continuous tubular sleeve material, wherein the sleeve receiver comprises a roller for receiving the sleeve material therearound, and wherein the sleeve advancer comprises a motorized mechanism configured to turn the sleeve receiver roller.

6. A hygienic handle assembly in accordance with claim 3, further comprising an indicator for indicating exhaustion of the sleeve supply.

7. A hygienic handle assembly in accordance with claim 6, wherein the indicator comprises a visual or audio cue when indicating.

8. A hygienic handle assembly in accordance with claim 6, wherein the indicator comprises a communications module associated with the handle and configured to transmit a communications signal from the handle assembly to a computing device.

9. A hygienic handle assembly in accordance with claim 8, wherein the communications module is configured to communication on a wireless communications network.

10. A hygienic handle assembly in accordance with claim 1, wherein the sleeve advancer is further configured to delay the advance of the sleeve when use of the handle by any user is detected during advancing of the sleeve.

11. A hygienic handle assembly in accordance with claim 1, further comprising a motion sensor connected to the sleeve advancer and configured to operate the sleeve advancer when detecting a user's hand proximate the handle.

12. A hygienic handle assembly in accordance with claim 1, further comprising a touch sensor connected to the sleeve advancer and configured to operate the sleeve advancer when detecting a user's hand releasing the handle.

13. A hygienic handle assembly in accordance with claim 1, further comprising an advancing circuit connected to the sleeve advancer and configured to operate the sleeve advancer when an electrical circuit is closed by an external force on the handle causing one of the second couplers to apply pressure against one of the first couplers with the sleeve therebetween.

14. A hygienic handle assembly in accordance with claim 1, further comprising a sanitizing unit configured to sanitize the sleeve before the sleeve is passed around the second magnetic couplers and the handle.

15. A hygienic handle assembly in accordance with claim 14, wherein the sanitizing unit comprises an ultraviolet light source sufficient to sanitize the sleeve.

16. A hygienic handle assembly in accordance with claim 14, wherein the sanitizing unit comprises a sanitizing spray unit configured to provide a sanitizing spray sufficient to sanitize the sleeve.

17. A hygienic handle assembly, comprising:

a handle shaft having a first end and a second end;

a first magnet attached to the first end of the handle shaft;

a first receptacle for loosely coupling with the first end of the handle shaft, the first receptacle having a second magnet configured to oppose a magnetic field of the first magnet such that the first end of the handle shaft is suspended within the first receptacle;

a second receptacle for loosely coupling with the second end of the handle shaft;

a sleeve configured to pass through the first and second receptacles and around the first and second ends of the handle shaft such that the sleeve encloses the first magnet from the second magnet; and a sleeve advancer configured to advance the sleeve over the handle shaft after use of the handle shaft by a user such that sleeve material covering the handle shaft prior to advancement is substantially replaced by new sleeve material after advancement, wherein the first receptacle and the second receptacle each have a passageway for allowing the sleeve to pass through the first and second receptacles.

18. A hygienic handle assembly in accordance with claim 17, wherein the first magnet comprises a cylindrical shape sized to fit within a stepped passage of the second magnet with the sleeve therebetween.

19. A hygienic handle assembly in accordance with claim 17, further comprising a third magnet attached to the second end of the handle shaft, wherein the second receptacle comprises a fourth magnet configured to oppose a magnetic field of the third magnet such that the second end of the handle shaft is suspended within the second receptacle, and wherein the sleeve encloses the third magnet from the fourth magnet.

20. A hygienic handle assembly in accordance with claim 19, further comprising:

a sleeve supply located proximate to the second magnet for providing the sleeve into the passage of the second magnet; and a sleeve receiver located proximate to fourth magnet for receiving the provided sleeve from a passage of the fourth magnet.

21. A hygienic handle assembly in accordance with claim 20, wherein the sleeve supply comprises a roll of continuous tubular sleeve material, wherein the sleeve receiver comprises a roller for receiving the sleeve material therearound, and wherein the sleeve advancer comprises a motorized mechanism configured to turn the sleeve receiver roller.

22. A hygienic handle assembly in accordance with claim 20, further comprising an indicator for indicating exhaustion of the sleeve supply.

23. A hygienic handle assembly in accordance with claim 17, wherein the sleeve advancer is further configured to delay the advance of the sleeve when use of the handle by any user is detected during advancing of the sleeve.

24. A hygienic handle assembly in accordance with claim 17, further comprising a motion sensor connected to the sleeve advancer and configured to operate the sleeve advancer when detecting a user's hand proximate the handle.

25. A hygienic handle assembly in accordance with claim 17, further comprising a touch sensor connected to the sleeve advancer and configured to operate the sleeve advancer when detecting a user's hand releasing the handle.

26. A hygienic handle assembly in accordance with claim 17, further comprising an advancing circuit connected to the sleeve advancer and configured to operate the sleeve advancer when an electrical circuit is closed by an external force causing the first magnet to be pressed against the second magnet with the sleeve therebetween.

27. A hygienic handle assembly in accordance with claim 17, further comprising a sanitizing unit configured to sanitize the sleeve before the sleeve is passed around the handle.

* * * * *